US005678657A

United States Patent [19]

Lee

[11] Patent Number: 5,678,657

[45] Date of Patent: Oct. 21, 1997

[54] LUBRICATING DEVICE FOR ROTARY COMPRESSORS

[75] Inventor: Sung-Jae Lee, Anyang, Rep. of Korea

[73] Assignee: Samsung Electronics Co., Ltd., Suwon, Rep. of Korea

[21] Appl. No.: 580,599

[22] Filed: Dec. 29, 1995

[30] Foreign Application Priority Data

Dec. 31, 1994 [KR] Rep. of Korea ..... 94-39604 U

[51] Int. Cl.[6] ..... F01M 1/00

[52] U.S. Cl. ..... 184/6.16; 418/88; 137/533.21

[58] Field of Search ..... 184/6.16, 6.11; 418/88; 137/533.21, 533.31

[56] References Cited

U.S. PATENT DOCUMENTS

| | | | |
|---|---|---|---|
| 4,561,829 | 12/1985 | Iwata et al. | 418/88 |
| 4,850,830 | 7/1989 | Okoma et al. | 418/88 |
| 5,180,291 | 1/1993 | Kent | 184/6 |
| 5,411,056 | 5/1995 | Solaroli | 137/527.4 |
| 5,470,214 | 11/1995 | Shin et al. | 418/88 |
| 5,529,469 | 6/1996 | Bushnell et al. | 418/88 |

FOREIGN PATENT DOCUMENTS

| | | | |
|---|---|---|---|
| 0031688 | 2/1986 | Japan | 418/88 |

*Primary Examiner*—Thomas E. Denion

*Attorney, Agent, or Firm*—Burns, Doane, Swecker & Mathis, L.L.P.

[57] ABSTRACT

A rotary compressor includes a cylinder and a motor-driven crankshaft. The crankshaft includes an eccentric portion disposed in the cylinder for forming therewith a compression chamber in which fluid is compressed. A vane is yieldably biased toward the eccentric portion to partition the compression chamber into high and low pressure portions. Consequently, the vane is reciprocated radially during rotation of the crankshaft. The crankshaft is mounted in a bearing which receives oil from an oil delivery system. That system includes an oil chamber communicating with an oil reservoir with which the vane communicates. A check valve is disposed in the oil chamber and is automatically cycled open and closed in response to variations in the fluid pressure in the oil chamber caused by reciprocation of the vane.

11 Claims, 6 Drawing Sheets

LUBRICATING DEVICE FOR ROTARY COMPRESSORS

BACKGROUND OF THE INVENTION

1. Field of the Invention

The present invention relates in general to rotary compressors used for compressing fluid, such as refrigerant of an air conditioner, prior to discharging the pressurized fluid. More particularly, the present invention relates to a structural improvement in lubricating devices of such rotary compressors not only for checking the reverse flow of the cooling and lubricating oil of an oil chamber but also for supplying a sufficient amount of oil around a crank shaft.

2. Description of the Prior Art

An example of a typical rotary compressor used for compressing fluid, such as refrigerant of an air conditioner, prior to outputting the pressurized fluid is disclosed in Japanese Patent Laid-open Publication No. Sho. 56-41473. The above Japanese rotary compressor is shown in the accompanying drawings, FIGS. 1 and 2. As shown in the drawings, the typical compressor includes a motor unit 2 which is provided in the upper section inside a compressor casing 1 . A compressing unit 3 is provided in the lower section inside the casing 1. The motor unit 2 includes a stator 4 and a rotor 5, while the compressing unit 3 comprises a compressing cylinder 6 and a piston 7 movably received in the cylinder 6. The rotor 5 of the motor unit 2 is connected to a piston rod 8 through a drive shaft or crank shaft 9. The middle portion of the crank shaft 9 is rotatably held by a main bearing 10, while the lower end portion of the shaft 9 is rotatably held by an auxiliary bearing 11.

The cylinder 6 is provided with a cylinder head 13 which in turn is provided with suction and exhaust valves 14 and 15. There is a muffler placed on top of the cylinder head 13. The top wall of the compressor casing 1 is provided with a refrigerant inlet pipe 17, while the side wall of the casing 1 is provided with a refrigerant outlet pipe 18.

Contained in the lower section of the casing 1 is cooling and lubricating oil 19. As shown in FIG. 2, both the auxiliary bearing 11 and the lower portion of the crank shaft 9 rotatable held by the auxiliary bearing 11 are immersed in the oil 19. The compressor also includes an oil pumping device for forcibly supplying the cooling and lubricating oil 19 to both bearings 10 and 11 of the crank shaft 9 thereby cooling and lubricating the frictional contact portions of the bearings 10 and 11. The oil pumping device includes a central hole 20*a* which is formed in the bottom center of the crank shaft 9 immersed in the oil 19. The central hole 20*a* communicates with an eccentric hole 20*b* through a connection hole 20*c* also formed in the crankshaft. The eccentric hole 20*b* is axially and eccentrically formed in the crank shaft 9. Mounted to the bottom end of the crank shaft 9 is a pump case 21 which closes both the bottom of the eccentric hole 20*b* and the side of the connection hole 20*c*. The bottom center of the pump case 21 is provided with a cylindrical mouth 22 which extends downward and communicates with the central hole 20*a* of the crank shaft 9. The cylindrical mouth 22 forms an oil inlet port. The central, eccentric and connection holes 20*a*, 20*b* and 20*c* of the crank shaft 9 constitute a lubricating passage 20 of the crank shaft 9. When the crank shaft 9 rotates at a high speed by the rotating force of the motor unit 2, the cooling and lubricating oil 19 is sucked into the central hole 20*a* of the crank shaft 9 through the cylindrical mouth 22 of the pump case 21 as shown in the arrows of FIG. 2. The oil sucked into the central hole 20*a* in turn is guided to the eccentric hole 20*b* through the connection hole 20*c* due to the centrifugal force generated by the rotating motion of the crank shaft 9. The oil guided into the eccentric hole 20*b* is, thereafter, supplied to the auxiliary bearing 11 and in turn supplied to the main bearing 10 thereby cooling and lubricating the frictional contact portions of the bearings 10 and 11.

The auxiliary bearing 11 is provided with a shielding plate 23 which is horizontally set in the lower section of the bearing to be spaced apart from the bottom end of the crank shaft 9. The shielding plate 23 closes the lower opening of the bearing 11. The shielding plate is provided with a center opening which receives the cylindrical mouth 22 of the pump case 21 thereby introducing the oil 19 into the oil passage 20 of the crank shaft 9.

In the operation of the rotary compressor, the rotor 5 of the motor unit 2 rotates to generate the rotating force when the motor unit 2 is applied with electric power. Due to the rotating motion of the rotor 5, the crank shaft 9 fitted to the rotor 5 rotates to transmit the rotating force to the piston 7 through the piston rod 8 thereby causing the piston 7 to linearly reciprocate in the cylinder 6. Due to the reciprocating motion of the piston 7, the gaseous refrigerant is introduced into the cylinder 6 through the refrigerant inlet pipe 17 and the suction valve 14 of the cylinder head 13. The gaseous refrigerant introduced in the cylinder 6 is compressed by the piston 7 into the gaseous refrigerant under pressure. The pressurized refrigerant in turn is discharged from the cylinder 6 through the exhaust valve 15 of the cylinder head 13 and passes through the muffler 16 prior to being discharged from the compressor through the refrigerant outlet pipe 18.

During the above operation of the rotary compressor, the rotating motion of the crank shaft generates a centrifugal force thereby causing the cooling and lubricating oil 19 to be introduced into the oil passage 20 of the crank shaft 9 through the cylindrical mouth 22 of the pump case 21. The oil 19 in turn flows up in the oil passage 20 of the crank shaft 9 in order to be supplied to the main bearing 10 thereby cooling and lubricating the frictional contact portions of the bearing 10. In this case, the oil 19 is supplied to the upper section of the motor unit 2 through the main bearing 10. Also, centrifugal force generated by the crank shaft 9 causes oil to be drawn into the bearing 11 through a gap ("play") between the mouth 22 and a wall of an opening 24 formed in the shielding plate 23. That oil flows along the outer periphery of the crank shaft 9 in a passage 25.

However, it has been noted that the above compressor has the following problems caused by pressure reduction of the oil in the oil passage of the crank shaft due to a structural limit of the oil pumping device. That is, as the cylindrical mouth 22 of the pump case 21 is inserted into the center opening 24 of the shielding plate 23 of the auxiliary bearing 11, it is possible to prevent the forming of a vortex of the cooling and lubricating oil 19 during the operation of the compressor. However, the oil passage 20 of the crank shaft 9 comprises the central hole 20*a* and eccentric hole 20*b* which communicate with each other through the horizontally formed connection hole 20*c* as described above. In this regard, the pressure of the oil 19 sucked into the passage 20 through the mouth 22 of the pump case 21 is primarily reduced in the top section of the central hole 20*a*. Thereafter, the pressure of the oil 19 is secondarily reduced while the oil 19 flows in the connection hole 20*c*, thereby failing to supply a sufficient amount of oil 19 to the upper section of the motor unit 2. In this regard, the above oil pumping device not only fails to achieve the smooth operation of the compressor, it also causes operational noise and vibrations of the compressor.

SUMMARY OF THE INVENTION

It is, therefore, an object of the invention to provide an improved lubricating device for rotary compressors in which the above problems can be overcome and which uniformly supplies the cooling and lubricating oil to all the frictional contact elements of the compressor by an oil checking valve means installed in an oil inlet port, thereby preventing an abnormal frictional abrasion and operational noise and vibrations of the compressor during the operation of the compressor.

In order to accomplish the above object, a lubricating device for a rotary compressor in accordance with an embodiment of the present invention comprises an oil chamber communicating with an oil reservoir provided in a lower section of the compressor through an oil inlet port, the oil inlet port introducing cooling and lubricating oil of the oil reservoir into the oil chamber in accordance with an eccentric rotating motion of an eccentric shaft, further comprises an oil checking valve means movably placed in the oil chamber and adapted for selectively closing the oil inlet port.

BRIEF DESCRIPTION OF THE DRAWINGS

Other objects and aspects of the invention will become apparent from the following description of embodiments with reference to the accompanying drawings, in which.

DESCRIPTION OF THE PREFERRED EMBODIMENTS

Figure 1:
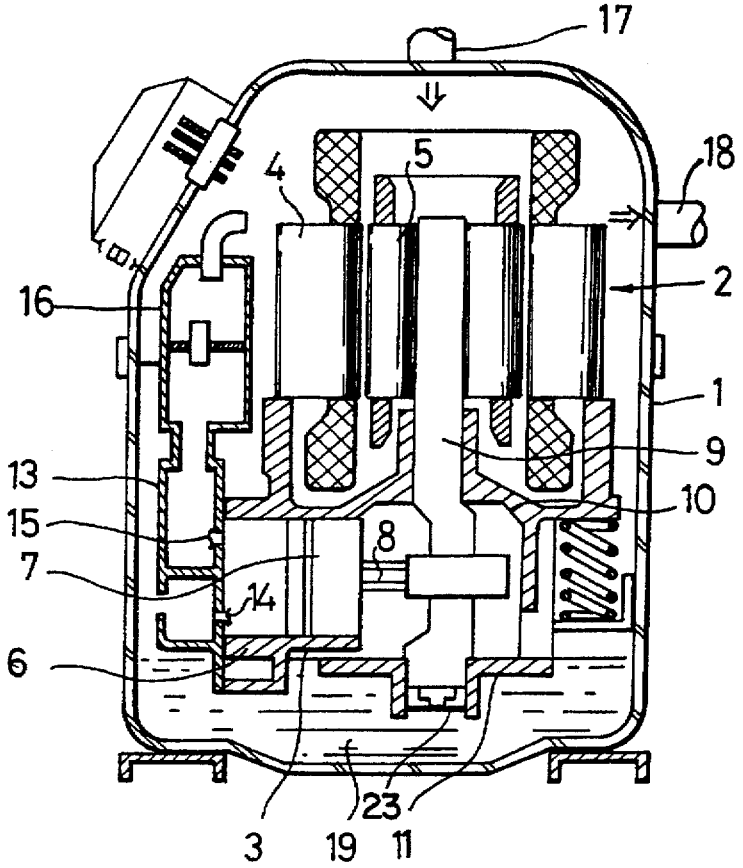
FIG.1 (PRIOR ART)
FIG. 1 is a sectional view showing the construction of a conventional rotary compressor.
Figure 2:
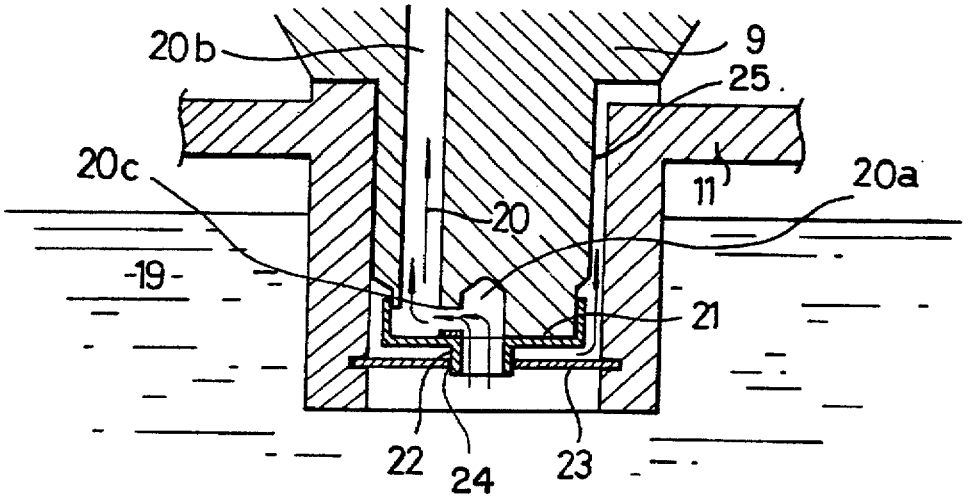
FIG.2 (PRIOR ART)
FIG. 2 is an enlarged sectional view showing a typical lubricating structure of the compressor of FIG. 1.
Figure 3:
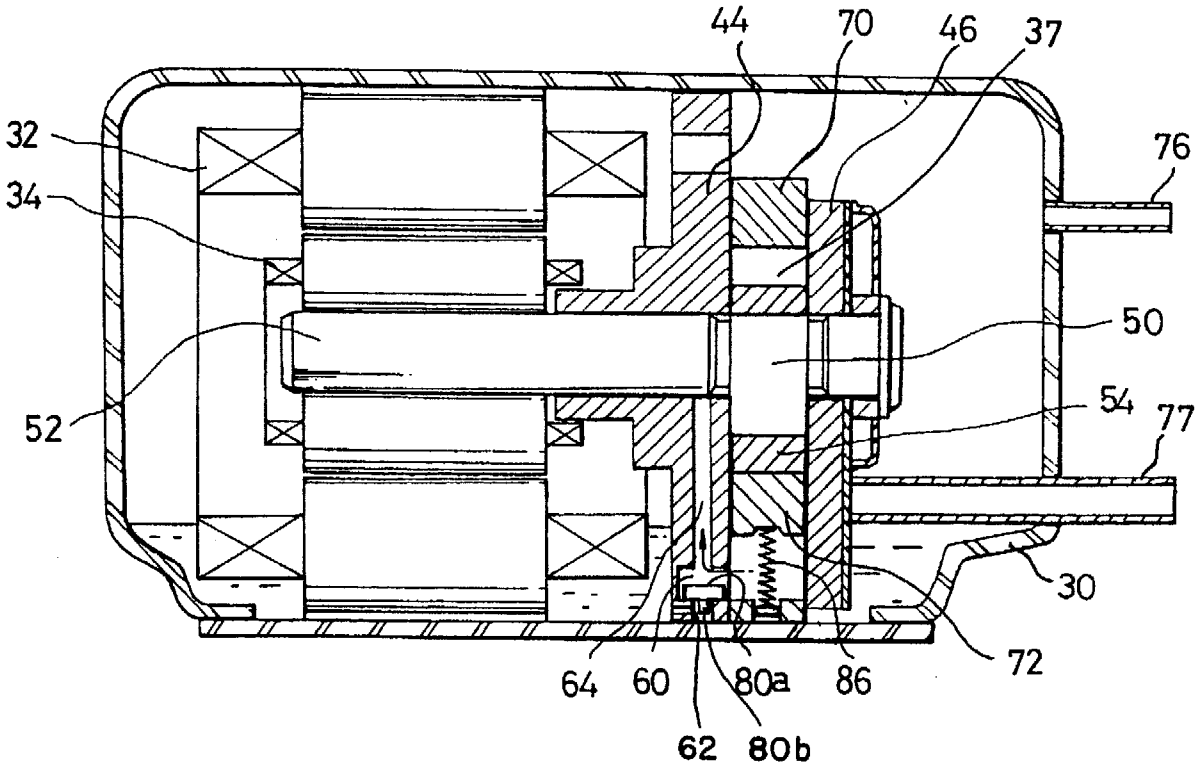
FIG. 3 is a sectional view of a rotary compressor provided with a lubricating device in accordance with a primary embodiment of the present invention.

As shown in FIGS. 3 to 6, the rotary compressor provided with the lubricating device of this invention includes a casing 30 which forms the profile of the compressor. The casing 30 receives a stator 32, rotor 34, crank shaft 52 and roller 54 therein. The stator 32 is fixed to the internal surface of the casing 30 and forms a magnetic field upon being applied with electric power, while the rotor 34 is rotated by the magnetic field of the stator 32 thereby generating the rotating force. The crank shaft 52 is connected to the rotor 34 thereby being rotated by the rotating force of the rotor 34. The crank shaft 52 is provided with an eccentric shaft 50 on one end portion thereof. The roller 54 is rotatably and slidably fitted over the eccentric shaft 50 of the crank shaft 52 thereby performing the rotating and sliding motion.

The above eccentric shaft 50 with the roller 54 is received in a compressing cylinder 70, thereby forming a refrigerant compressing chamber 37 in the cylinder 70. A refrigerant outlet pipe 76 extends from the casing 30. The high pressure and temperature refrigerant which has been compressed in the compressing chamber 37 of the cylinder 70 due to the eccentric rotating motion of the eccentric shaft 50 is discharged to a refrigerant circulating cycle through the outlet port 76. The casing 30 also includes a refrigerant inlet pipe 77 which is adapted for introducing the gaseous refrigerant into the compressing chamber 37 of the cylinder 70 after the refrigerant has traversed the cycle.

Figure 6:
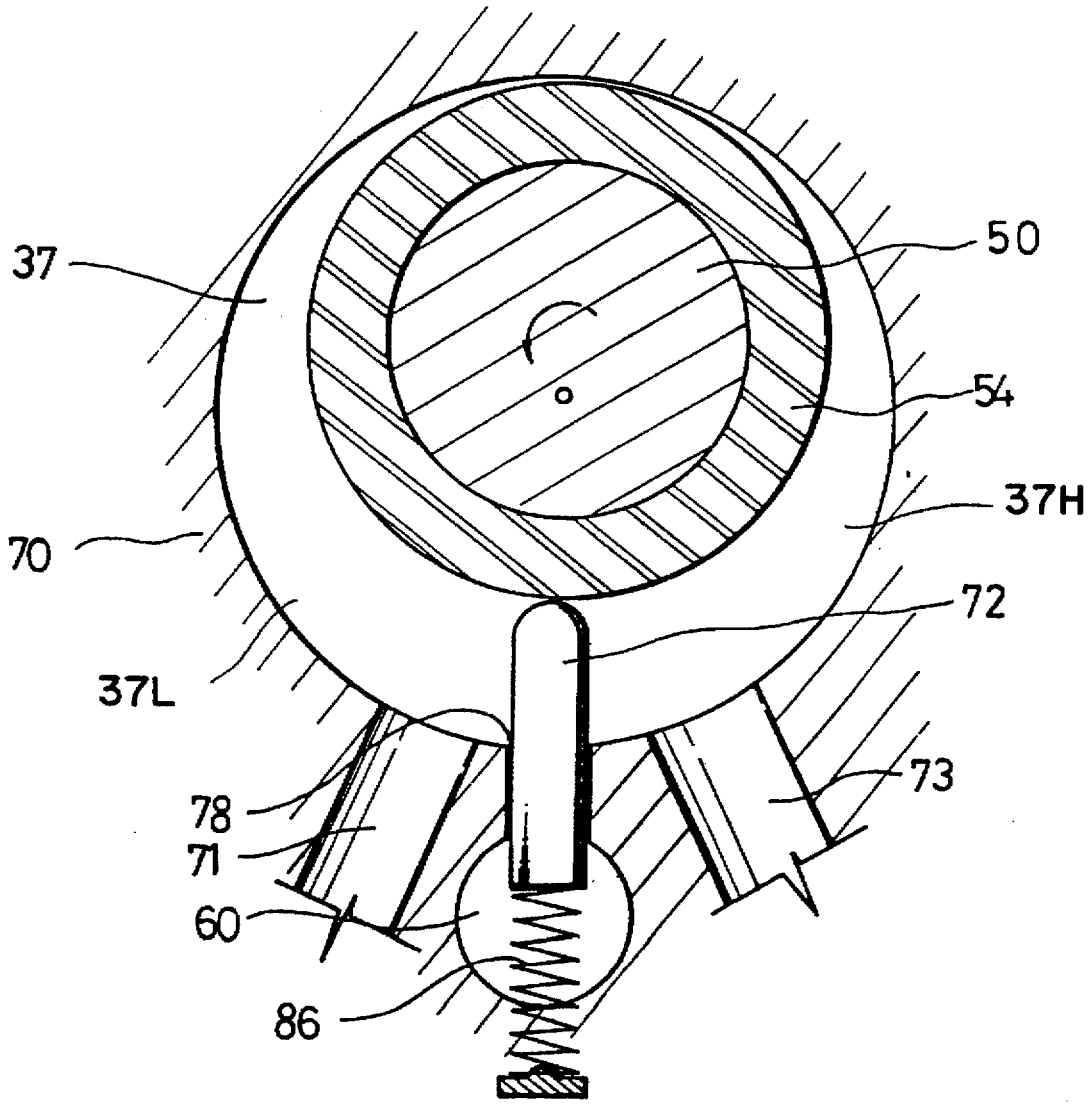
FIG. 6 is a view representing the operation of the above lubricating device.

As shown in FIG. 6, the cylinder 70 is provided with a vane slot 78 which receives a spring-biased vane 72 therein. The tip of the spring-biased vane 72 always comes into contact with the outer surface of the roller 54 thereby dividing the compressing chamber 37 of the cylinder 70 into two chambers, that is, a suction chamber 37L (low pressure chamber) and an exhaust chamber 37H (high pressure chamber).

The vane 72, which is received in the vane slot 78, is biased by a spring means 86 such as a compression coil spring thereby repeatedly elastically moving relative to the roller 54 in accordance with the rotating motion of the eccentric shaft 50. The cylinder 70 is covered by first and second bearings 44 and 46 to form the chamber 37. The chamber 37 is divided into the high and low pressure chambers by the spring-biased vane 72. The cylinder 70 is provided with refrigerant suction and exhaust ports 71 and 73 as shown in FIG. 6. The low pressure chamber of the cylinder 70 communicates with the refrigerant inlet pipe 77 through the suction port 71. Hence, the low temperature and pressure refrigerant of the inlet pipe 77 is introduced into the low pressure chamber 37L of the cylinder 70 through the suction port 71. Meanwhile, the high pressure chamber 37H of the cylinder 70 communicates with the refrigerant outlet pipe 76 through the exhaust port 73. Hence, the high temperature and pressure refrigerant compressed in the cylinder 70 is discharged to the refrigerant circulating cycle through the exhaust port 73 and outlet pipe 76.

The eccentric shaft 50 is integrally formed with the crank shaft 52 into a single body. The roller 54, which is fitted over the eccentric shaft 50, performs the rotating and sliding motion in accordance with the rotating motion of the crank shaft 52 as described above. The first and second bearings 44 and 46 not only cover both sides of the cylinder 70 to form the chamber 37 in the cylinder 70, they also rotatably hold the crank shaft 52.

The lubricating device of the above compressor has an oil chamber 60 which is formed in the first bearing 44. The first bearing 44 also has an oil inlet port 62 which introduces the cooling and lubricating oil into the oil chamber 60. The oil chamber 60 communicates with the frictional contact portion between the first bearing 44 and crank shaft 52 through an oil passage 64 formed in the first bearing 44. An oil check valve means 80 is movably placed in the above oil chamber 60 in order to check the amount of the oil which is supplied to the frictional contact portion between the bearing 44 and shaft 52. The valve means 80 comprises a head 80*a* and a leg 80*b*. The head 80*a* has a diameter larger than those of both the oil inlet port 62 and the oil passage 64 of the bearing 44, thereby selectively closing either the oil inlet port 62 or the passage 64. Meanwhile, the leg 80*b* is integrally fixed to the bottom of the head 80*a*. The leg 80*b* is movably received in the oil inlet port 62 of the first bearing 44.

The above valve head 80*a* is a disc whose diameter is larger than that of the oil inlet port 62. The valve head 80*a* is selectively seated on the oil inlet port 62 thereby selectively closing the inlet port 62. The valve leg 80*b*, which is movably received in the inlet port 62, has a diameter smaller than that of the inlet port 62. Due to the diameter difference between the port 62 and leg 80*b*, the cooling and lubricating oil is introduced into the oil chamber 60 through the gap formed between the port 62 and leg 80*b* when the valve head 80*a* is lifted due to low pressure of the oil chamber 60.

As the valve leg 80*b* is fixed to the bottom center of the valve head 80*a* and movably received in the oil inlet port 62, the leg 80*b* is lifted along with the head 80*a* when the oil is introduced into the oil chamber 60 through the oil inlet port 62. The leg 80*b* in turn is lowered along with the head 80*a* when the oil of the oil chamber 60 is supplied to the frictional contact portion between the bearing 44 and shaft 52 through the oil passage 64 of the bearing 44.

The operation of the above rotary compressor will be described hereinbelow.

When the stator 32 is applied with electric power, it forms a magnetic field thereby causing the rotor 34 to rotate. Due to the rotating motion of the above rotor 34, the crank shaft 52 which is concentrically fitted in the rotor 34 rotates at a high speed. Due to the rotating motion of the crank shaft 52, the roller 54 which is fitted over the eccentric shaft 50 of the crank shaft 52 rotates eccentrically in the cylinder 70. During the eccentric rotating motion of the roller 54 in the cylinder 70, the spring-biased vane 72 elastically and linearly reciprocates under the guide of the vane slot 78, thus discharging the pressurized hot refrigerant from the high pressure chamber of the cylinder 70 through the exhaust port 73.

That is, as the volume of the suction and exhaust chambers of the cylinder 70 varies in accordance with the eccentric rotating motion of the eccentric shaft 50, the refrigerant introduced into the cylinder 70 is compressed into the pressurized hot refrigerant. The pressurized hot refrigerant in turn is discharged from the cylinder 70 through the exhaust port 73 which is selectively opened by the roller 54. The exhaust port 73 is closed by the roller 54 just after discharging the pressurized hot refrigerant, while the suction port 71 is opened by the roller 54 in order to introduce low temperature and pressure refrigerant into the cylinder 70. During the refrigerant compressing operation of the compressor, the volumes of the suction and exhaust chambers inside the cylinder 70 continuously vary by the eccentric rotating motion of the shaft 50.

During the refrigerant compressing operation of the compressor, it is required to continuously supply the cooling and lubricating oil to both the crank shaft 52 and roller 54 as will be described later herein. That is, both the crank shaft 52 and the roller 54 fitted over the eccentric shaft 50 may be frictionally abraded as they rotate in the first bearing 44 and in the cylinder 70 respectively at a high speed. Therefore, the frictional contact portions of the shaft 52 and roller 54 have to be supplied with oil to resist frictional abrasion.

As a result of the eccentric rotating motion of the eccentric shaft 50 with the roller 54 in the cylinder 70, the spring biased vane 72 linearly elastically reciprocates under the guide of the vane slot 78. Due to the linear reciprocation of the vane 72, the spring means 86 of the vane 72 is compressed and extended and the volume and pressure of the oil chamber 60 is changed.

Figure 4:
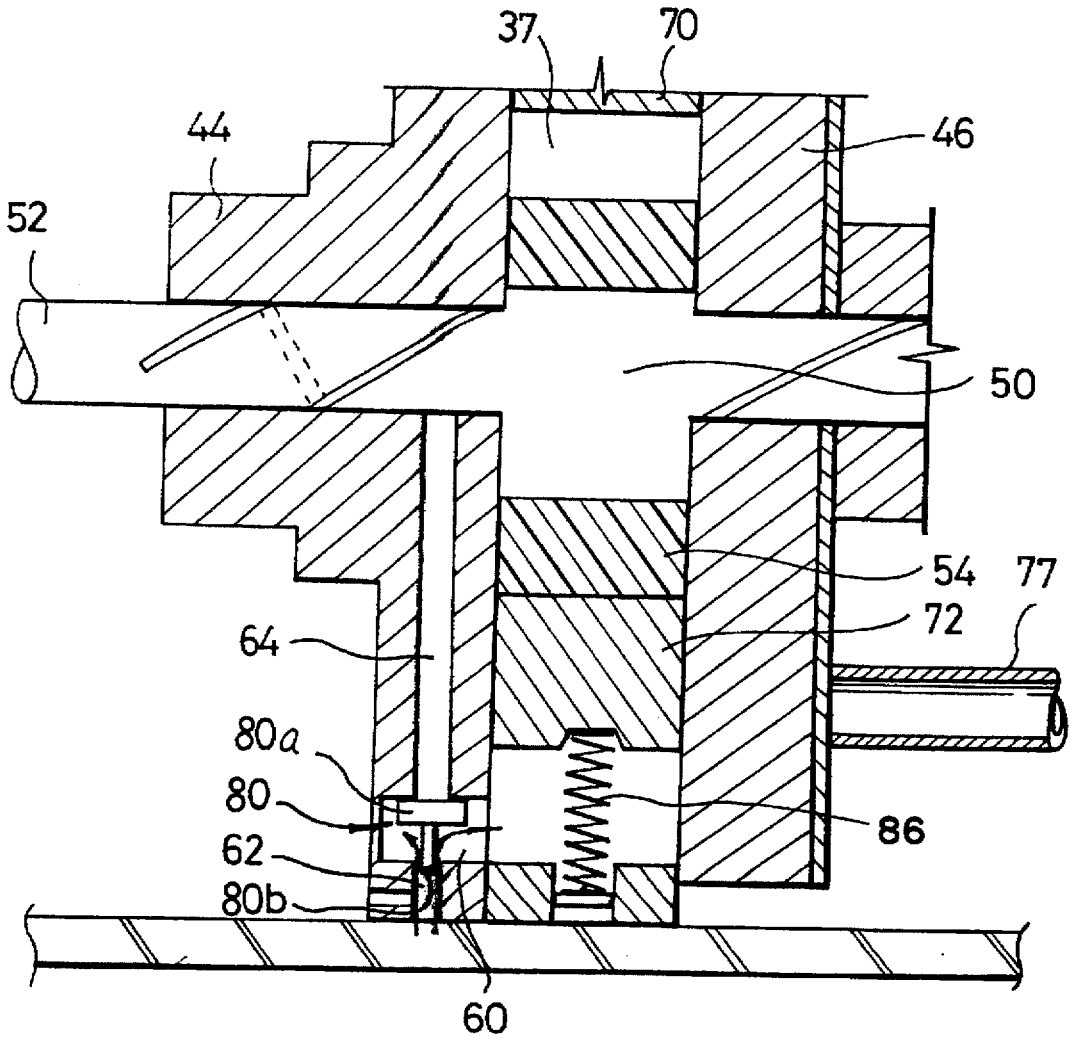
FIG. 4 is an enlarged sectional view of the above lubricating device, showing an oil checking valve of the lubricating device in its lifted position.
Figure 5:
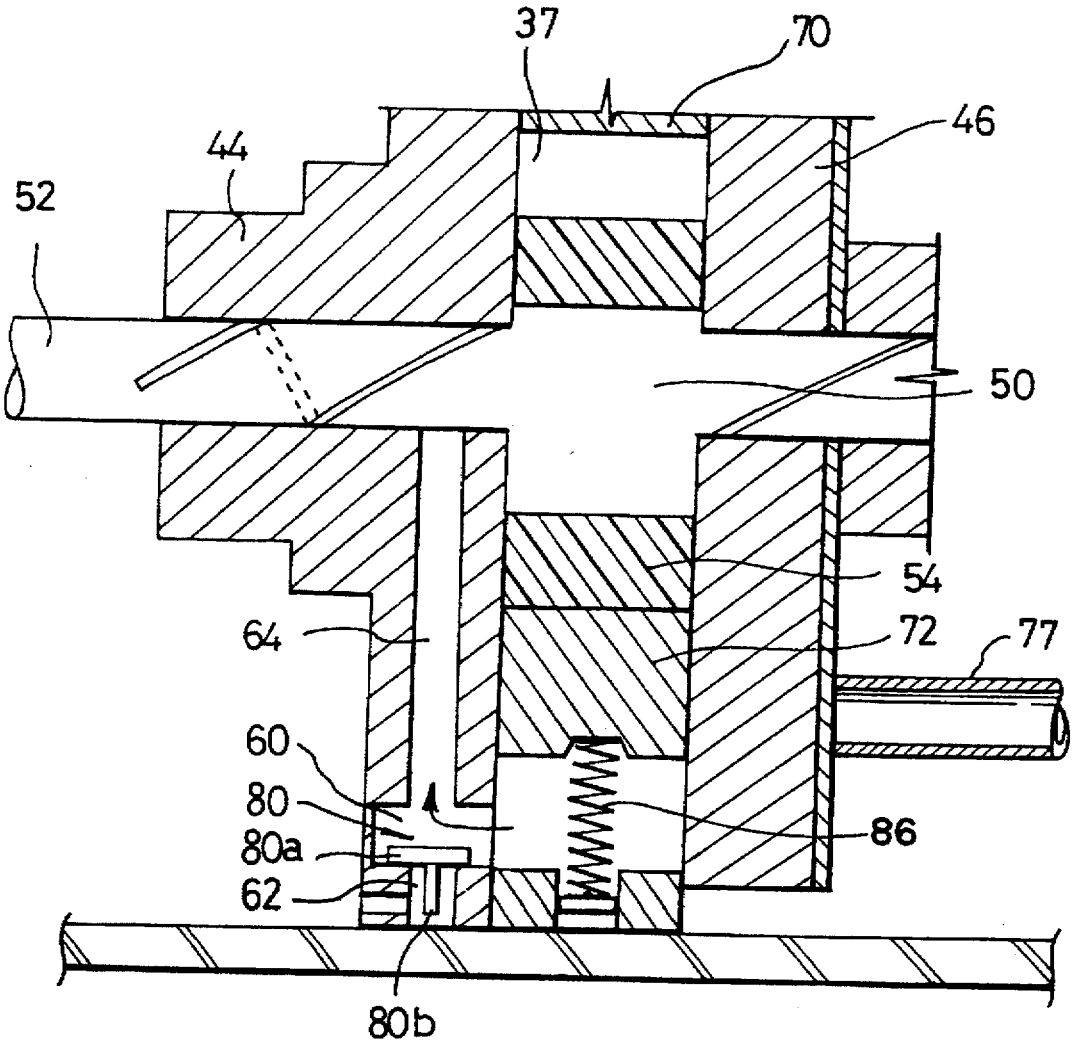
FIG. 5 is an enlarged sectional view of the above lubricating device, showing the oil checking valve of the lubricating device in its lowered position.

When the vane 72 elastically moves up as shown in FIG. 6, the volume of the oil chamber 60 is enlarged to reduce the pressure of the chamber 60. In that state, the lubricating oil lifts the valve means 80 up as shown in FIG. 4, thus causing oil to be introduced into the low pressure oil chamber 60 through the oil inlet port 62.

However, when the vane 72 elastically moves down, the volume of the oil chamber 60 is reduced to increase the pressure of the chamber 60. In that state, the lubricating oil which has been introduced into the oil chamber 60 is supplied from the high pressure chamber 60 to the crank shaft 52 through the low pressure passage 64. In this case, the lubricating oil presses the valve head 80*a* down thereby closing the oil inlet port 62 and preventing the oil of the chamber 60 from leaking.

Figure 7:
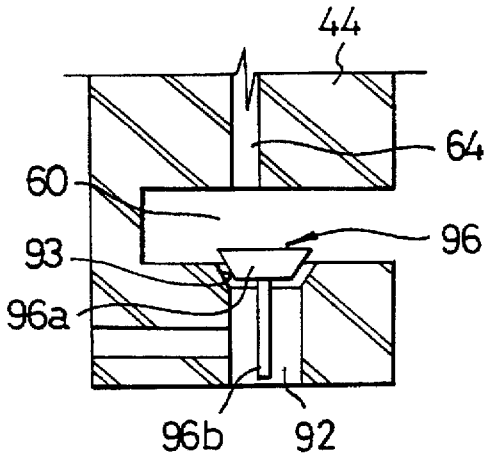
FIG. 7 is a sectional view showing the construction of a lubricating device in accordance with another embodiment of the present invention.

FIG. 7 is a sectional view showing the construction of a lubricating device in accordance with a second embodiment of the present invention.

In the second embodiment, the general shape of the lubricating device remains the same as in the primary embodiment of FIGS. 3 to 6, but the configurations of both the valve head and the top section of the oil inlet port are changed in order to have countersunk configurations. That is, the head 96*a* of an oil check valve means 96 of this embodiment is countersunk to form a countersunk head. In the same manner, the top section of the oil inlet port 92 formed in the first bearing 44 is countersunk to correspond to the configuration of the countersunk head 96*a* of the valve means 96. The top section of the port 92 forms a countersunk valve seat 93.

In the operation of the lubricating device according to the second embodiment, the spring-biased vane 72 elastically and linearly reciprocates under the guide of the vane slot 78 due to the eccentric rotating motion of the roller 54 in the cylinder 70. Due to the linear reciprocation of the vane 72, the spring means 86 of the vane 72 is compressed and extended and the volume and pressure of the oil chamber 60 is changed.

When the vane 72 elastically moves up, the volume of the oil chamber 60 is enlarged to reduce the pressure of the chamber 60. In that state, the lubricating oil lifts the valve means 96 up, thus causing oil to be introduced into the low pressure oil chamber 60 through the high pressure oil inlet port 92.

However, when the vane 72 elastically moves down, the volume of the oil chamber 60 is reduced to increase the pressure of the chamber 60.

In that state, the lubricating oil which has been introduced into the oil chamber 60 is supplied from the high pressure chamber 60 to the crank shaft 52 through the low pressure passage 64. In this case, the lubricating oil presses the countersunk valve head 96*a* down, thereby seating the head 96*a* in the countersunk valve seat 93 of the oil inlet port 92. The oil inlet port 92 is thus closed to prevent the oil of the chamber 60 from leaking.

Figure 8:
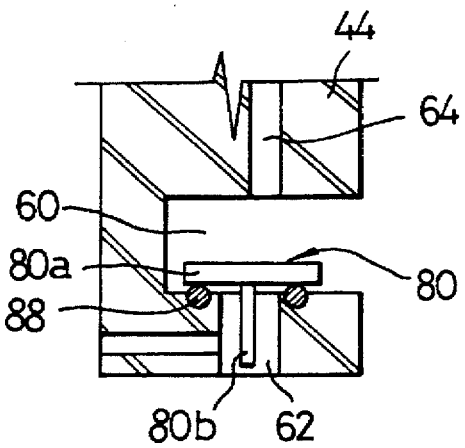
FIG. 8 is a sectional view showing the construction of a lubricating device in accordance with a further embodiment of the present invention.

FIG. 8 is a sectional view showing the construction of a lubricating device in accordance with a third embodiment of the present invention.

In the third embodiment, the general shape of the lubricating device remains the same as in the primary embodiment of FIGS. 3 to 6. However, the lubricating device of this embodiment includes a damping means which reduces the operational noise generated from the contact portion between a valve head 80*a* and the oil chamber's bottom surface during the vertical movement of an oil check valve means 80 in the oil chamber 60. The damping means includes a damper 88 which is set in the bottom surface of the oil chamber 60 around the oil inlet port 62. The damper 88 is set in the bottom surface of the chamber 60 in order to partially protrude from the chamber's bottom surface. When the valve means 80 is fully lowered as shown in FIG. 8, the top of the damper 88 thus comes into close contact with the bottom surface of the valve head 80*a*, thereby preventing oil leakage through the oil inlet port 62. In the present invention, it is preferable to use an O-ring, which is made of a natural rubber, plastic material or synthetic rubber, as the damper 88.

Figure 9:
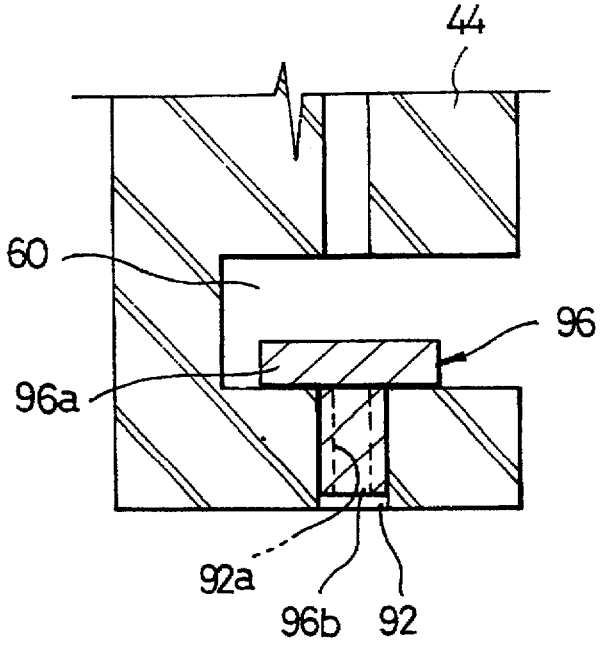
FIG. 9 is a sectional view showing the construction of a lubricating device in accordance with yet another embodiment of the present invention.
Figure 10A:
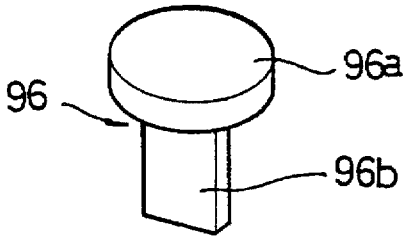
FIG. 10A is a perspective view of an oil checking valve of the lubricating device of FIG. 9.
Figure 10B:
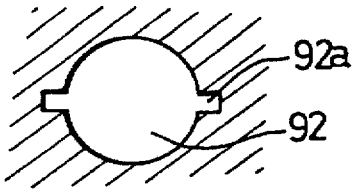
FIG. 10B is a sectional view of an oil inlet port of the lubricating device taken through FIG. 9.

FIG. 9 is a sectional view showing the construction of a lubricating device in accordance with a fourth embodiment of the present invention. FIG. 10A is a perspective view of an oil check valve means of the lubricating device of FIG. 9. FIG. 10B is a sectional view of an oil inlet port of the lubricating device of FIG. 9.

In the fourth embodiment, the general shape of the lubricating device remains the same as in the primary embodiment of FIGS. 3 to 6. However, the lubricating device of this fourth embodiment includes a guide means for guiding the vertical movement of the oil check valve means 96 while preventing any play of the valve means 96 in the oil inlet port 92. The guide means comprises a pair of grooves 92*a* which guides the leg 96*b* of the valve means 96 during the vertical movement of the oil checking valabove grooves 92*a* above grooves 92*a* are vertically formed on opposite side walls of the oil inlet port 92. The leg 96*b* of the valve means 96 has a rectangular cross-section thereby being movably received in the grooves 92*a* of the oil inlet port 92.

The operation effects of the lubricating devices according to the third and fourth embodiments of the present invention are similar to those of the primary and second embodiments and are thereby not described in this specification.

As described above, the present invention provides a structurally improved lubricating device for rotary compressors. In the lubricating device, an oil check valve means is installed in the oil inlet port thereby not only preventing a reverse flow of the cooling and lubricating oil which has been introduced into the oil chamber through the oil inlet port but also supplying a sufficient amount of oil to the frictional contact portion between the crank shaft and the bearing. Therefore, the lubricating device of the present invention not only prevents abnormal frictional abrasion of the rotating and sliding elements of the compressor, it also prevents operational noise and vibrations of the compressor.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A rotary compressor comprising:

a casing;

a stationary cylinder disposed in said casing and including a fluid inlet and a fluid outlet;

a bearing disposed in said casing;

a motor-driven crankshaft disposed in said casing and rotatably supported by said bearing, said crankshaft including an eccentric portion disposed in said cylinder for forming therewith a compressing chamber in which fluid is compressed in response to rotation of said crankshaft;

an oil reservoir disposed in said casing; and an oil delivery system for conducting oil from said reservoir to said bearing, said oil delivery system comprising:

an oil chamber disposed in said casing and communicating with said reservoir through an oil inlet port and communicating with said cylinder through an oil passage, said oil inlet port conducting oil to said oil chamber in response to rotation of said crankshaft; and a reciprocable check valve for selectively opening and closing said oil inlet port, said check valve including a valve head disposed within said oil chamber and being larger than said oil inlet port for closing said oil inlet port, and a valve leg joined to said valve head and extending through said valve inlet port, a cross section of said valve leg being smaller than a cross section of said valve inlet port, said check valve being reciprocable in a direction of fluid flow through the valve inlet port.

2. The rotary mechanism according to claim 1 wherein said bearing engages an inner wall of said casing and includes a bore through which said crankshaft extends, said stationary cylinder being disposed axially adjacent said bearing so that said bearing forms a wall of said compression chamber, said oil chamber being formed inside said bearing, and said oil passage being entirely formed inside said bearing.

3. The rotary mechanism according to claim 1, further including an element mounted for movement in response to rotation of said eccentric portion for alternately establishing high and low pressure states in said oil chamber.

4. The rotary compressor according to claim 3 wherein said element includes a vane disposed in said cylinder and elastically biased toward said eccentric portion for partitioning said compression chamber into high pressure and low pressure portions, said vane being reciprocated by said eccentric portion during rotation of said crankshaft, said vane communicating with said oil chamber for establishing said high and low pressure states therein.

5. The rotary compressor according to claim 1 wherein said valve head is disc shaped.

6. The rotary compressor according to claim 1 wherein said valve head is countersunk.

7. The rotary compressor according to claim 1 further including a resilient damper compressed between said valve and a surface in which said oil inlet port is formed, when said check valve is in a position closing said oil inlet port.

8. The rotary compressor according to claim 1 wherein said oil inlet port includes a wall having a groove formed therein, a portion of said valve leg being guided for movement in said groove.

9. A rotary compressor comprising:

a casing:

a stationary cylinder disposed in said casing and including a fluid inlet and a fluid outlet;

a bearing disposed in said casing;

a motor-driven crankshaft disposed in said casing and rotatably supported by said bearing, said crankshaft including an eccentric portion disposed in said cylinder for forming therewith a compression chamber in which fluid is compressed in response to rotation of said crankshaft;

an oil reservoir disposed in said casing; and an oil chamber disposed in said casing and communicating with said reservoir through an oil inlet port and communicating with said cylinder through an oil passage;

an element mounted for movement in response to rotation of said eccentric portion for alternately establishing high and low pressure states in said oil chamber; and a check valve in said oil chamber and arranged for movement to a first position in response to the generation of said low pressure state in said oil chamber, and movable to a second position in response to the generation of said high pressure state in said oil chamber, said check valve arranged to open said oil inlet port and close said oil passage when in said first position to permit oil to enter said oil chamber, said check valve arranged to open said oil passage and close said oil inlet port when in said second position to enable oil in said oil chamber to be discharged through said oil passage.

10. The rotary compressor according to claim 9 wherein said element includes a vane disposed in said cylinder and elastically biased toward said eccentric portion for partitioning said compression chamber into high pressure and low pressure portions, said vane being reciprocated by said eccentric portion during rotation of said crankshaft, said vane communicating with said oil chamber for establishing said high and low pressure states therein.

11. The rotary mechanism according to claim 9 wherein said bearing engages an inner wall of said casing and includes a bore through which said crankshaft extends, said stationary cylinder being disposed axially adjacent said bearing so that said bearing forms a wall of said compression chamber, said oil chamber being formed within said bearing, and said oil passage being entirely formed in said bearing.

* * * * *